United States Patent [19]

Nichoalds

[11] Patent Number: 4,718,741

[45] Date of Patent: Jan. 12, 1988

[54] ELECTRIFIED TABLE AND SUPPORT STRUCTURE

[75] Inventor: Donald L. Nichoalds, Libertyville, Ill.

[73] Assignee: Luxor Corporation, Waukegan, Ill.

[21] Appl. No.: 927,673

[22] Filed: Nov. 6, 1986

[51] Int. Cl.[4] ..... A47B 81/00

[52] U.S. Cl. ..... 312/223; 312/320

[58] Field of Search ..... 312/250, 223, 320; 180/19.1; 280/79.1, 47.34; 248/74.3, 74.1

[56] References Cited

U.S. PATENT DOCUMENTS

| | | | |
|---|---|---|---|
| 2,340,713 | 2/1944 | Tinnerman | 248/74.3 |
| 2,561,293 | 7/1951 | Ross | 280/47.34 K |
| 3,471,109 | 10/1969 | Meyer | 248/74.3 X |
| 3,593,950 | 7/1971 | Tetzlaff | 248/74.3 |
| 3,759,538 | 9/1973 | Fabiano | 280/47.35 |
| 3,783,175 | 1/1974 | Timmons | 312/223 X |
| 4,066,305 | 1/1978 | Gazarek | 312/223 X |
| 4,323,291 | 4/1982 | Ball | 312/223 X |

FOREIGN PATENT DOCUMENTS

| | | | |
|---|---|---|---|
| 124433 | 5/1944 | Australia | 312/223 |

*Primary Examiner*—Joseph Falk

*Attorney, Agent, or Firm*—Wood, Dalton, Phillips, Mason & Rowe

[57] ABSTRACT

An electrified table top. In one form, the table wall forms the top of a base defining a cabinet. The table wall includes an integral, outwardly projecting handle portion provided with integral electrical connection structure for selective connection of power cords from electrical apparatus carried on the table wall. The electrical connection structure is provided with a power cord which may be selectively plugged into a conventional power supply receptacle. The table wall is provided with a selectively closable opening for passing the flexible electrical cords therethrough. Structure is provided for supporting the flexible cords on the underside of the table wall. Where the structure includes a base cabinet portion, the cabinet is provided with one or more openings for passing the cords to and from the handle portion.

19 Claims, 12 Drawing Figures

FIG. 7
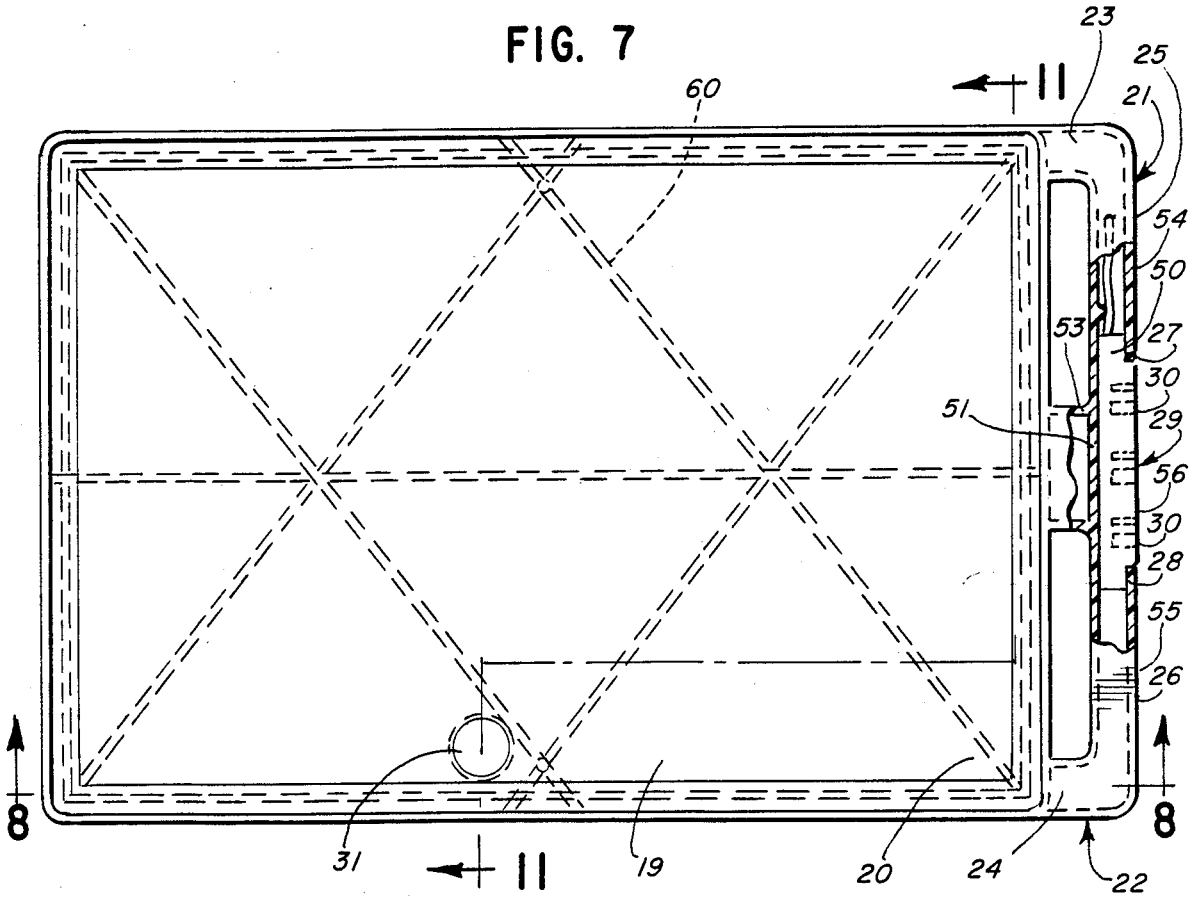
FIG. 8
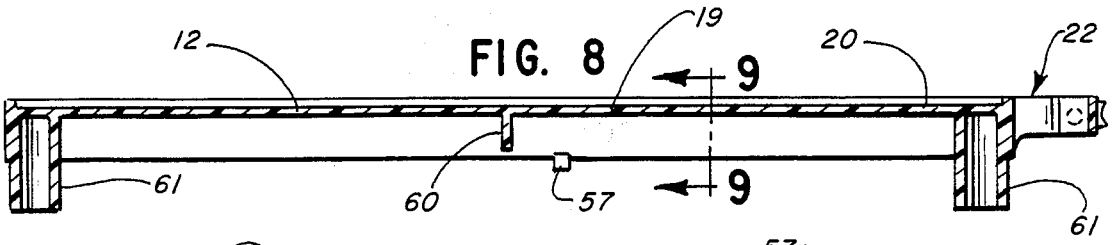
FIG. 9
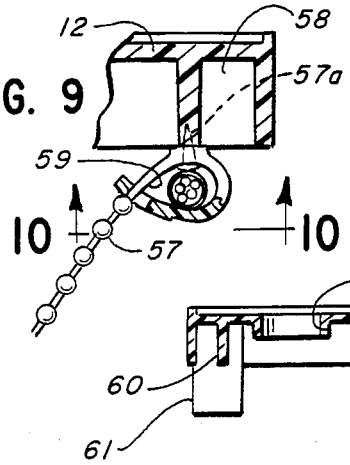
FIG. 10
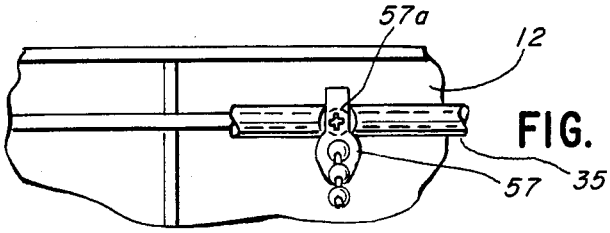
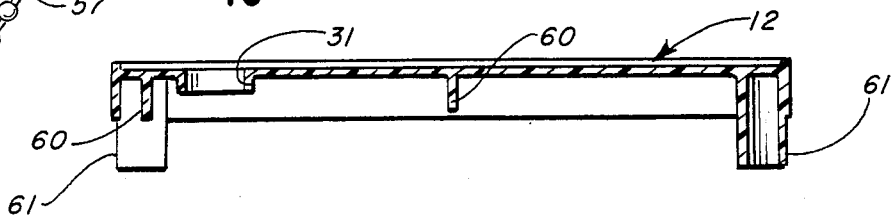
FIG. 11

ELECTRIFIED TABLE AND SUPPORT STRUCTURE

TECHNICAL FIELD

This invention relates to support structures and in particular to a support structure having a novel table wall provided with improved means for providing electrified power to electrically operable equipment removably placed on said wall.

BACKGROUND ART

In one form of table support, the support defines a top wall on which electrical apparatus may be supported. Examples of such supports are legged tables, mobile audiovisual carts utilized for carrying slide projectors or movie projectors, etc. Conventionally, such carts may include lower base portions defining a cabinet which may be selectively closed by a door, as for storing the material to be displayed by the audiovisual equipment. Such carts include conventional casters which may further include locking means for retaining the cart in the desired position during use of the electrical equipment.

It is conventional to connect the electrical equipment to conventional female power supply receptacles in the building wall, etc., by means of the conventional flexible power cords provided with the equipment.

DISCLOSURE OF INVENTION

The present invention comprehends an improved table wall defining a support having integral means for facilitated electrical connection of electrically operable devices supported on the table wall.

In one illustrative form, the invention comprehends such a table structure including a cabinet base having a top wall and defining an accessible inner space, handle means on the base adjacent the top wall, electrical connection means associated with the handle means, means in the base for passing a flexible electrical cord therethrough to have one end thereof disposed above the top wall and the opposite end thereof electrically connected to the connection means, means for electrically energizing the connection means from an electrical power source comprising a flexible electrical power cord, and means for supporting the power cord on the table wall to have one end thereof connected to the connection means and the opposite end thereof extended from the support structure to be plugged into an electrical power source receptacle.

In the illustrated embodiment, the table wall includes a support portion defining an end, a pair of handle portions each having a connecting portion extending from the table wall and a turned grasping portion, the grasping portions of the handles defining opposed spaced distal ends. The grasping portions are spaced from the table wall support portion end to receive a user's fingers therebetween. Electrical connection means are mounted between the distal ends and define an electrical terminal connector. Means are provided for passing an electrical cord from the table wall support portion through the handle portions to the electrical connection means for electrical connection thereof to the electrical terminal connector for electrically energizing the terminal connector from an electrical power source to provide electrical power to an electrical cord connected to the terminal connector for providing electrical power therethrough to electrically operable objects supported on the table wall.

The invention further comprehends the provision of passage means in the cabinet base and/or the table wall for passing electrical cords and the like therethrough between the electrical connection means associated with the handle and the electrical equipment being carried on the table wall.

The invention comprehends the provision of closure means for partially closing the passage means in the table wall after the plug means of the flexible cords are passed therethrough.

Means are provided for effecting ready selective connection of the cords associated with the objects placed on the table wall to the connection means at the handle.

Supports are provided on the table wall for supporting the cords.

Means may be provided on the table wall or cabinet for storing an elongated distal end of the power cord during storage or transport of the support structure.

The improved support structure of the invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 7 is a plan view shown partially in section, of the table wall defining the top of the cabinet;

FIG. 8 is a vertical section taken substantially along the line 8—8 of FIG. 7;

FIG. 9 is a fragmentary vertical section taken substantially along the line 9—9 of FIG. 8;

FIG. 10 is a fragmentary horizontal section taken substantially along the line 10—10 of FIG. 9;

FIG. 11 is a diagonally transverse section taken substantially along the line 11—11 of FIG. 7.

BEST MODE FOR CARRYING OUT THE INVENTION

Figure 1:
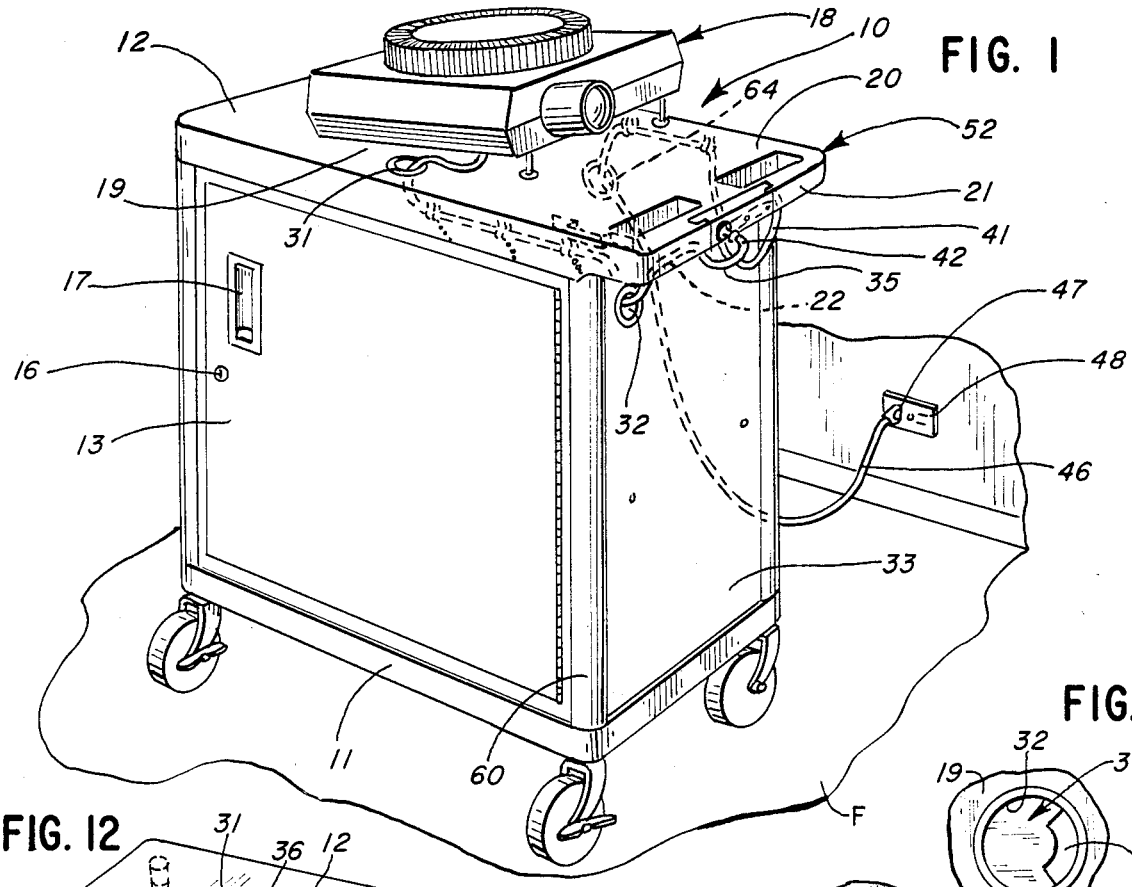
FIG. 1 is a perspective view of a cabinet structure having a table wall embodying the invention illustrating the use thereof with a slide projector energized from a building wall power receptacle.

In the illustrative embodiment of the invention as disclosed in the drawing, a structure generally designated 10 is shown to comprise a mobile table, or cart. In one form, the structure includes a cabinet base 11 with the table wall 12 defining the top wall of the base.

In the illustrated embodiment, the cabinet base is provided with a hinged door 13 providing selective access to the space within the cabinet base. Casters 14 are mounted to the bottom of the base for providing movement of the cabinet structure, in the form of a cart, along a subjacent floor surface. Conventional caster locks 15 may be provided for locking one or more of the casters to retain the cart in a desired fixed position during use thereof. Where the table wall is utilized without the cabinet base, the casters are fitted to the lower ends of the table legs, such as legs 62 illustrated in FIG. 12.

Door 13 may be provided with a conventional lock 16 and recessed door handle 17, as shown in FIG. 1.

Such a cabinet structure is adapted for use as an audiovisual display table wherein a projector, such as slide projector 18 illustrated in FIG. 1, is mounted on the top wall 12, with the cart serving as a stand for the projector at that time. The invention comprehends a novel means for providing for electrical connection of the electrically operable projector, or other apparatus utilized on the table wall 12.

More specifically, in the present invention, table wall 12 defines a support portion 19 having an end 20. A pair of handles 21 and 22 include connecting portions 23 and 24 and turned grasping portions 25 and 26, respectively, as shown in FIG. 7.

The grasping portions 25 and 26 define opposed, spaced distal ends 27 and 28, respectively. The grasping portions, as shown in FIG. 7, are spaced from the table wall end 20 sufficiently to permit a user's fingers to be received therebetween in grasping the handles, such as in moving the cart on the subjacent floor surface F.

The invention comprehends the provision of electrical connection means generally designated 29 mounted between the distal ends 27 and 28 of the handle grasping portions. The electrical connection means includes a plurality of electrical terminal connectors 30, such as conventional female power receptacles.

Means are provided for passing an electrical cord through the support portion 19 of the table wall. In the illustrated embodiment, the cord passing means comprises an opening 31 in the table wall adapted to pass the flexible electrical cord from the projector 18 downwardly through the table wall, along the lower side of the table wall within the cabinet base, and outwardly through an opening 32 in an end wall 33 of the cabinet base for permitting the male connector plug 34 at the distal end of the flexible cord to be electrically connected to a female receptacle 30 in the electrical connection means 29.

In the illustrated embodiment, the openings 31 and 32 are sufficiently large to pass the male plug freely therethrough. A plurality of such cords 35 may be extended through the openings as desired.

Figure 4:
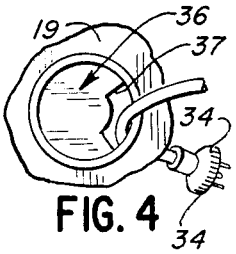
FIG. 4 is a view similar to that of FIG. 3 but illustrating the provision of a closure element in the table wall opening.

As illustrated in FIG. 4, a closure element 36 may be installed in the opening 31 to define a smaller opening 37 for passing only the cord, i.e. not the plug 34, therethrough.

Figure 3:
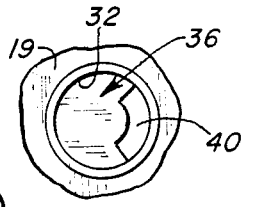
FIG. 3 is a fragmentary enlarged illustration of an opening in the table wall.
Figure 5:
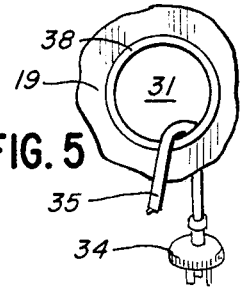
FIG. 5 is a view similar to that of FIG. 3 but illustrating the provision of a power cord through an opening in the closure element.
Figure 6:
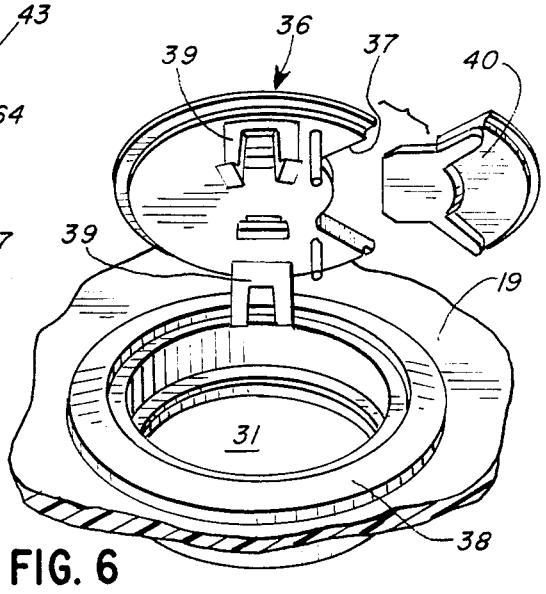
FIG. 6 is a fragmentary enlarged perspective view of the closure element in association with a table wall opening structure.

As illustrated in FIG. 6, each opening may include a grommet 38 received in the table wall opening 31 and the closure element may be provided with spring fingers 39 adapted to releasably engage the grommet in holding the closure element in the opening when desired. A tab 40 may be provided to be removably mounted to the closure element 36 to define a closure of the smaller opening 37 for completely closing the opening when desired, as shown in FIG. 3.

Figure 2:
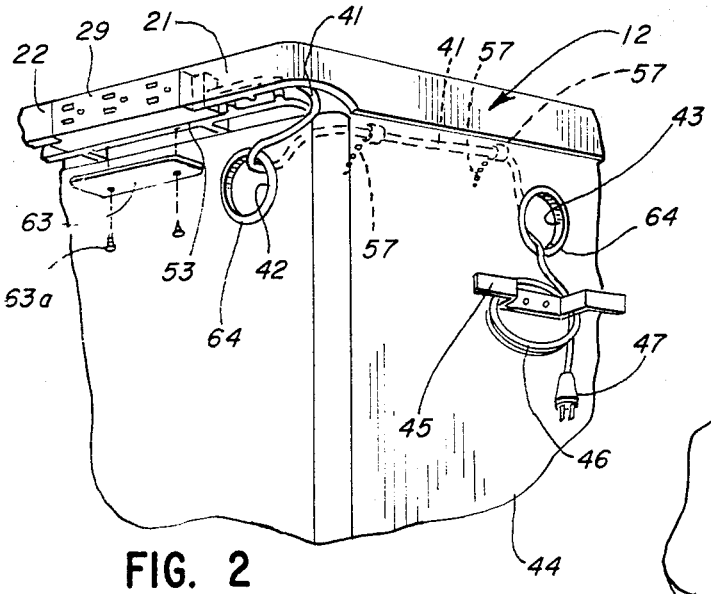
FIG. 2 is a fragmentary enlarged rear perspective view thereof.

Electrical power is provided to the electrical connection means 29 by means of a power cord 41 which extends from the electrical connection means through an opening 42 in the end wall 33, through the interior of the cabinet base, and outwardly through an opening 43 in the rear wall 44 of the cabinet base. As shown in FIG. 2, a cord support 45 may be mounted to the rear wall for wrapping of the distal end 46 of the power cord thereabout when the cart is not in use or being transported. The power cord may be provided with a conventional male plug 47 for connection to a conventional female power receptacle 48, as illustrated in FIG. 1.

Thus, when the power cord 41 is electrically connected to the power supply receptacle 48, electrical power is provided to the electrical connection means 29 for energizing the apparatus 18 through the connection cord 35 connected between the electrical connection means receptacle 30 and the apparatus 18 through the cabinet base.

As illustrated in greater detail in FIG. 7, the electrical connection means 29 comprises an insulating body 49 having opposite ends 50 defining opposite end surface complementary to the nonplanar end surfaces of the grasping portion ends 27 and 28 to extend into facially abutting engagement with the grasping portions, thereby supporting the electrical connection means between the handles 21 and 22 so as to define a continuous U-shaped handle structure generally designated 52 extending outwardly from the table wall end 20.

To provide improved support for the handles and electrical connection means, the grasping portions are provided with an intermediate portion 51 having a connecting portion 53 extending integrally from the table wall end 20 and providing a support wall inwardly of the electrical connection means. The connecting portion 53 rigidifies the mounting of the electrical connection means between the handle distal ends 27 and 28, as seen in FIG. 7.

As will be obvious to those skilled in the art, the electrical connection means may be secured further in the assembly by a support plate 63 secured to the boss 53 by suitable screws **63*a***.

The electrical connection means is effectively disposed intermediate the grasping portions of the handle structure and, thus, is not contacted in the normal manipulation of the cart.

As further shown in FIG. 7, the grasping portions 25 and 26 of the handle structures define outer surfaces 54 and 55 facing away from the table wall support portion. The electrical connection means defines an outer surface 56 which is substantially flush with the surfaces 54 and 55 in the illustrated embodiment.

As further shown in the drawing, the grasping portions of the handle means defines rectangular transverse cross sections, and the electrical connection means defines a similar rectangular transverse cross section.

As shown in FIG. 1, the electrical terminal connectors 30 are disposed for connection of the electrical cord plugs thereto by movement of the plugs toward the support portion end 20.

The table wall may be formed of a molded synthetic resin, and the handles 21 and 22 and supporting boss 51 may be formed unitarily integral therewith.

The invention comprehends the provision of cord supporting elements 57 for supporting the cords within the cabinet base 11. As shown in FIG. 9, the cord supporting elements 57 may comprise clips secured to depending bosses 58 on the underside of the table wall 12 by screws 57a and defining openings 59 for receiving the electrical cord. The clips may be trimmed to proper size as desired.

The table wall may be provided with suitable depending reinforcing ribs 60 and may include depending sockets 61 for receiving corner posts 62 of the cabinet base.

Figure 12:
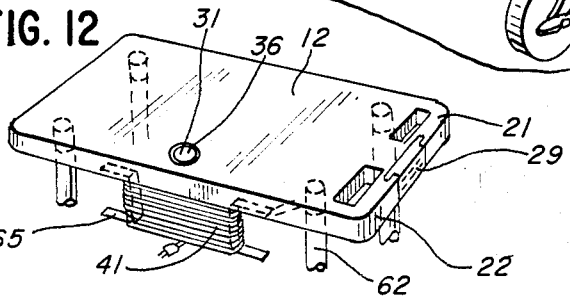
FIG. 12 is a fragmentary perspective view of the support structure in the form of a table.

Referring to FIG. 12, in another form of the invention, the table wall 12 is supported on the upright legs, or posts, 62 independently of any cabinet panels subjacent thereto. The table wall is provided with the handles 21 and 22 and interposed electrical connection means 29, as in the embodiment of FIG. 1. However, the power cord 41 is carried on the underside of the table wall 12 by means of a wire support 65 depending therefrom, as shown in FIG. 12. In all other respects, the arrangement of FIG. 12 is similar to the arrangement of FIG. 1, permitting the use of the table wall for carrying audiovisual equipment and the like, with improved means for effecting electrical connection thereof to the electrified connection means 29.

INDUSTRIAL APPLICABILITY

The electrified table structure of the present invention is advantageously adapted for use as a table or as an audiovisual cart wherein audiovisual equipment, such as projector 18, may be stored within the cabinet base, together with materials to be displayed by means of the audiovisual equipment.

The cabinet structure, or cart, is readily positionable on the subjacent floor surface F by releasing the caster locks 15 and utilizing the handles 21 and 22 to manipulate the cart thereon.

The provision of the electrical connection means integral with the handles provides for facilitated selective electrical connection of one or more electrical devices disposed on the table, or cabinet, as desired.

The supporting of the power cords on the underside of the table wall by the support element 57 prevents the cords from becoming entangled, or interfering with the placement in or removal from of material relative to the cabinet base 11 in the cabinet form of the invention.

The use of the selectively installable closure elements 36 permits ready passage of the power cord plug through the opening 31 provided in the wall 12, while yet the opening may be reduced in size upon the extension of the smaller cross section electrical connector portion of the cords through the openings. As indicated above, a plurality of openings may be provided in the cabinet base upright walls which may be provided with suitable grommets 64, as illustrated in FIGS. 1 and 2.

As the distal end of the power cord 41 may be wrapped about the support 45 or support 65, the power cord is neatly carried by the table construction while yet it may be readily released therefrom for connection to the power receptacle 48, when desired. desired.

The table wall and mobile cabinet constructions of the present invention are extremely simple and economical of construction while yet providing for an improved, low cost, highly efficient electrified support advantageously adapted for use with audiovisual apparatus and the like.

The foregoing disclosure of specific embodiments is illustrative of the broad inventive concepts comprehended by the invention.

I claim:

1. A table wall for use with an upright support means to support objects placed thereon, said table wall comprising:

a support portion defining an end;

a pair of handles each having a connecting portion extending from said support portion end and a grasping portion turned from said connecting portion, the grasping portions of the handles defining opposed spaced distal ends, said grasping portions being spaced from said support portion end to receive a user's fingers therebetween;

electrical connection means mounted between said distal ends and having an electrical terminal connector;

means for passing an electrical cord through said support portion and to adjacent said electrical connection means for selective connection thereof to said electrical terminal connector; and means for electrically energizing said terminal connector from an electrical power source to provide electrical power to an electrical cord connected to said terminal connector for providing electrical power therethrough to electrically operable objects supported on said support portion of the table wall.

2. The table wall of claim 1 wherein a boss is provided on said support portion end to project therefrom into abutment with said electrical connection means for rigidifying the mounting of the electrical connection means between said handle distal ends.

3. The table wall of claim 1 wherein said handle distal ends define nonplanar end surfaces and said electrical connection means defines opposite end surfaces complementary to and facially abutting said nonplanar end surfaces.

4. The table wall of claim 1 wherein said grasping portions of the handles define outer surfaces facing away from said support portion of the table wall, and said electrical connection means defines an outer surface substantially flush with said grasping portions outer surfaces.

5. The table wall of claim 1 wherein said grasping portions of the handles define rectangular transverse cross sections and said electrical connection means defines a similar rectangular transverse cross section.

6. The table wall of claim 1 wherein said electrical terminal connector is mounted between said handles for connection of an electrical cord connector thereto by movement of the electrical cord connector toward said support portion end.

7. The table wall of claim 1 wherein said handles are formed unitarily integral with said support portion.

8. The table wall of claim 1 wherein a boss is provided on said support portion end to project therefrom into abutment with said electrical connection means for rigidifying the mounting of the electrical connection means between said handle distal ends, and said boss and said handles are formed unitarily integral with said support portion.

9. The table wall of claim 1 including securing means for fixedly securing said electrical connection means between said distal ends of the handle grasping portions.

10. A cabinet structure comprising:

a cabinet base having a top wall and an accessible inner space;

handle means projecting outwardly from said base adjacent said top wall;

electrical connection means on the outwardly projecting handle means;

means in said base for passing a flexible electrical cord therethrough to have one end thereof disposed above said top wall and the opposite end thereof electrically connected to said connection means;

means for electrically engaging said connection means from an electrical power source comprising a flexible electrical power cord; and means in said base for passing said power cord therethrough to have one end thereof connected to said connection means and the opposite end thereof extended from said cabinet base to be plugged into an electrical power source receptacle.

11. The cabinet structure of claim 10 wherein means are provided on said cabinet base in said space for supporting flexible electrical cords thereon.

12. The cabinet structure of claim 10 wherein means are provided on said cabinet base in said space for readily releasably supporting flexible electrical cords thereon.

13. The cabinet structure of claim 10 wherein means are provided on said top wall in said space for supporting flexible electrical cords thereon.

14. The cabinet structure of claim 10 wherein means are provided on said top wall in said space for readily releasably supporting flexible electrical cords thereon.

15. The cabinet structure of claim 10 wherein said means for passing flexible cords through said base includes at least one opening in said top wall.

16. The cabinet structure of claim 10 wherein said means for passing flexible cords through said base includes at least one opening in said top wall and at least one opening in said base below said top wall.

17. The cabinet structure of claim 10 wherein said means for passing flexible cords through said base includes at least one opening in said top wall and closure means for selectively partially closing or fully closing each said opening.

18. The cabinet structure of claim 10 wherein said means for passing flexible cords through said base includes at least one opening in said top wall and at least one opening in said base below said top wall and closure means for selectively partially closing or fully closing at least one said opening in said top wall.

19. The cabinet structure of claim 10 wherein means are provided on said cabinet base for removably storing said opposite end of the electrical power cord thereon.

* * * * *